US005645459A

United States Patent [19]

Fitting

[11] Patent Number: 5,645,459

[45] Date of Patent: Jul. 8, 1997

[54] ELECTRICAL CONNECTOR WITH FEMALE CONTACT SECTION HAVING DUAL CONTACT AREAS AND STATIONARY HOUSING MOUNTS

[75] Inventor: Paul E. Fitting, Camp Hill, Pa.

[73] Assignee: Burndy Corporation, Norwalk, Conn.

[21] Appl. No.: 214,811

[22] Filed: Mar. 16, 1994

[51] Int. Cl.[6] ..... H01R 11/22

[52] U.S. Cl. ..... 439/857; 439/852

[58] Field of Search ..... 439/842, 857, 439/861, 962, 636, 637

[56] References Cited

U.S. PATENT DOCUMENTS

| | | | |
|---|---|---|---|
| 2,391,425 | 12/1945 | Korn | 173/363 |
| 2,490,317 | 12/1949 | Ostrak | 173/363 |
| 3,550,067 | 12/1970 | Hansen | 339/217 |
| 3,704,441 | 11/1972 | Douglass | 339/220 T |
| 3,715,629 | 2/1973 | Swengel, Sr. | 317/101 R |
| 3,808,578 | 4/1974 | Hansen | 439/857 |
| 3,966,295 | 6/1976 | Hyland et al. | 439/746 |
| 4,002,400 | 1/1977 | Evans | 439/851 |
| 4,572,606 | 2/1986 | Neumann et al. | 339/262 R |
| 4,753,616 | 6/1988 | Molitor | 439/787 |
| 4,786,262 | 11/1988 | Molitor et al. | 439/843 |
| 4,892,492 | 1/1990 | Mueller | 439/828 |

FOREIGN PATENT DOCUMENTS

| | | | |
|---|---|---|---|
| 1447759 | 6/1966 | France | 439/851 |
| 0168088 | 2/1982 | Netherlands | 439/851 |

*Primary Examiner*—David L. Pirlot
*Attorney, Agent, or Firm*—Perman & Green

[57] ABSTRACT

An electrical connector with a housing and electrical contacts. The contacts each have contact leaves with a general "M" shape. Front ends of the leaves are stationarily entrapped in a pocket of the housing. Rear ends of the leaves are stationarily connected to the housing by means of a middle section of each contact being fixed to the housing.

13 Claims, 2 Drawing Sheets

ELECTRICAL CONNECTOR WITH FEMALE CONTACT SECTION HAVING DUAL CONTACT AREAS AND STATIONARY HOUSING MOUNTS

BACKGROUND OF THE INVENTION

1. Field of the Invention

The present invention relates to electrical connectors and, more particularly, to contacts with dual contact areas and portions stationarily mounted to a connector housing.

2. Prior Art

U.S. Pat. No. 4,786,262 discloses a jack that is spring loaded in an outer sleeve body by a spring-loaded contact element in an interior recess of the outer sleeve body. U.S. Pat. No. 4,572,606 discloses contact springs fixed on one end, but having an opposite end freely movable in an annular gap of a bush housing. U.S. Pat. No. 4,892,492 discloses dual contact by spring elements on a pin. U.S. Pat. No. 3,550,067 discloses a resilient tongue and tab captured in a recess of a housing to mount a contact to the housing. U.S. Pat. No. 4,753,616 discloses a double contact spring socket with spring contacts having two middle sections for receiving male contacts.

SUMMARY OF THE INVENTION

In accordance with one embodiment of the present invention an electrical connector is provided comprising a housing and electrical contacts. The housing has contact receiving areas. The electrical contacts are fixedly mounted to the housing and are located, at least partially, in the contact receiving areas. At least some of the contacts each include a female receiving area. The female receiving area has a first end stationarily fixed to the housing, a second end stationarily entrapped in a pocket of the housing, and a middle section between the two ends adapted to be contacted by a male contact inserted into the female receiving area.

In accordance with another embodiment of the present invention an electrical connector is provided comprising a housing, and an electrical contact. The housing has a contact receiving area. The electrical contact is fixedly mounted to the housing inside the contact receiving area. The contact has a tail end extending out of the housing, a middle section fixedly mounted to the housing in the receiving area, a front end stationarily entrapped in a pocket of the housing, and a female contact section between the middle section and the front end for receiving a male contact.

In accordance with another embodiment of the present invention an electrical connector is provided comprising a housing, and an electrical contact. The housing has a contact receiving area. The electrical contact is fixedly mounted to the housing in the receiving area. The contact has a first portion stationarily connected to the housing, a spaced second portion stationarily connected to the housing, and a female contact section between the first and second portions. The contact section has two inwardly projecting ridges and an outwardly projecting ridge between the two inwardly projecting ridges that contacts the housing.

In accordance with one method of the present invention, a method of making contact between a female contact section of a first contact in a first electrical connector and a male contact section of a second contact in a second electrical connector is provided comprising steps of inserting the male contact section into a receiving area of the female contact section; connecting a first set of contact areas on leaves of the female contact section by the male contact section at a first depth of insertion into the female contact section; contacting and moving a second set of contact areas on the leaves by the male contact section at a second depth of insertion into the female contact section; and increasing force exerted by the first set of contact areas on the male contact section as the male contact section moves the second set of contact areas, the leaves contacting a housing of a first connector between the first and second sets of contact areas and being stationarily mounted to the housing at opposite ends of the leaves, wherein the movement of the second set of contact areas causes a moment to be created, due to the contact of the leaves with the housing, to increase the force that the first set of contact areas exert on the male contact section.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
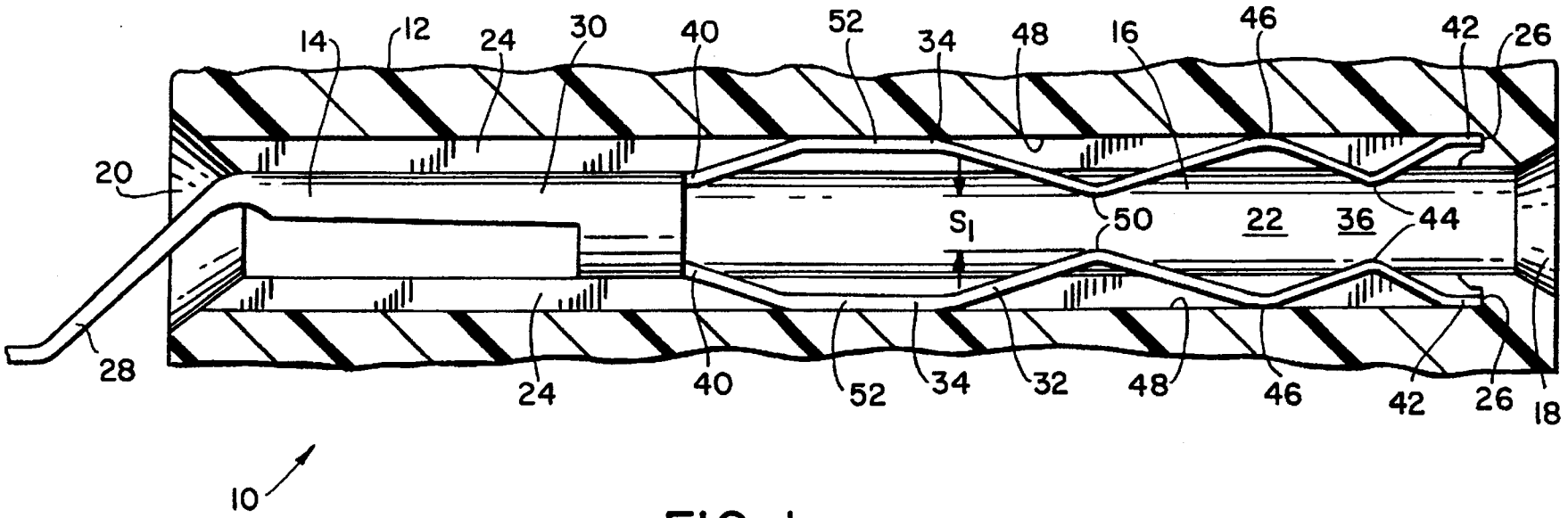
FIG. 1 is a partial sectional view of an electrical connector incorporating features of the present invention.

Referring to FIG. 1, there is shown a partial schematic sectional view of an electrical connector 10 incorporating features of the present invention. Although the present invention will be described with reference to the single embodiment shown in the drawings, it should be understood that features of the present invention can be incorporated into various different forms and types of alternate embodiments. In addition, any suitable size, shape and type of elements or materials could be used.

The connector 10 generally comprises a housing 12 and a plurality of electrical contacts 14 (only one of which is shown for the sake of simplicity). The housing 12 is preferably made of dielectric material such as molded polymer or plastic. The housing includes a plurality of contact receiving areas 16 (only one of which is shown for the sake of simplicity). The contact receiving areas 16 each comprise an open front aperture 18, an open rear aperture 20, a center channel 22 between the two apertures, and two leaf channels 24 on opposite sides of the center channel 22. Located at the front of the two leaf channels 24 are pockets 26. In alternate embodiments, other shapes of contact receiving areas could be provided.

The contacts 14 each comprise a tail end 28, a middle section 30 and a female contact section 32. The contacts 14 are preferably comprised of a sheet of flat metal that is cut and stamped to form the shape of the contact shown. The contacts 14 are fixedly mounted to the housing 12 in the contact receiving areas 16 with the tail ends 28 extending out of the rear apertures 20. The tail ends 28 form through-hole solder tails for connection to a printed circuit board (not shown). However, in alternate embodiments the tail ends 28 could be surface mount solder tails or, could be left off of the contacts, such as when an electrical wire passes through the rear aperture 20 and is connected to the middle section 30. The middle section 30 is pressed into the center channel 22 of the receiving area 16 through the rear aperture 20. The middle section 30 makes an interference fit with the housing 12 to thereby fixedly secure the contact 14 to the housing 12. In alternate embodiments, other suitable means could be used to stationarily fix the middle section 30 to the housing 12. The female contact section 32, in the embodiment shown, generally comprises two opposing contact leaves or arms 34 that extend from the middle section 30 in general cantilever fashion. The two leaves 34 form a female receiving area 36 for receiving a male contact 38 (see FIGS. 2 and 3). A first end of the area 36 extends to the middle section 30 of the contact 14. An opposite second end of the receiving area 36 is located proximate the front aperture 18. The receiving area 36 extends between the two ends.

Each leaf 34 is basically a mirror image of the opposite leaf. The leaves 34 each have a rear end 40 connected to the middle section 30 and a front end 42 located in the pockets 26 of the housing 12. The leaves 34 have a type of zig-zag or "M" shaped pattern into and out of the center channel 22 and leaf channels 24. The front ends 42 of the leaves are substantially stationarily entrapped in the pockets 26 against outer walls 48. As the leaves 34 extend out of the pockets 26 they extend out of the leaf channels 24 and into the center channel 22. The leaves 34 form a first set of inwardly projecting ridges 44 as they extend back out of the center channel 22 into their leaf channels 24. The leaves 34 change direction again to form a first set of outwardly projecting ridges 46 that are in contact with the housing 12 at the outer walls 48 of the leaf channels 24. The leaves 34 extend back into the center channel 22 and out again to form a second set of inwardly projecting ridges 50. Finally, the leaves 34 form a second set of outwardly projecting ridges 52 located against the outer walls 48 of the leaf channels 24 before the leaves 34 extend to the middle section 30. FIG. 1 shows the contact 14 in its home position without a male contact connected to it.

Figure 2:
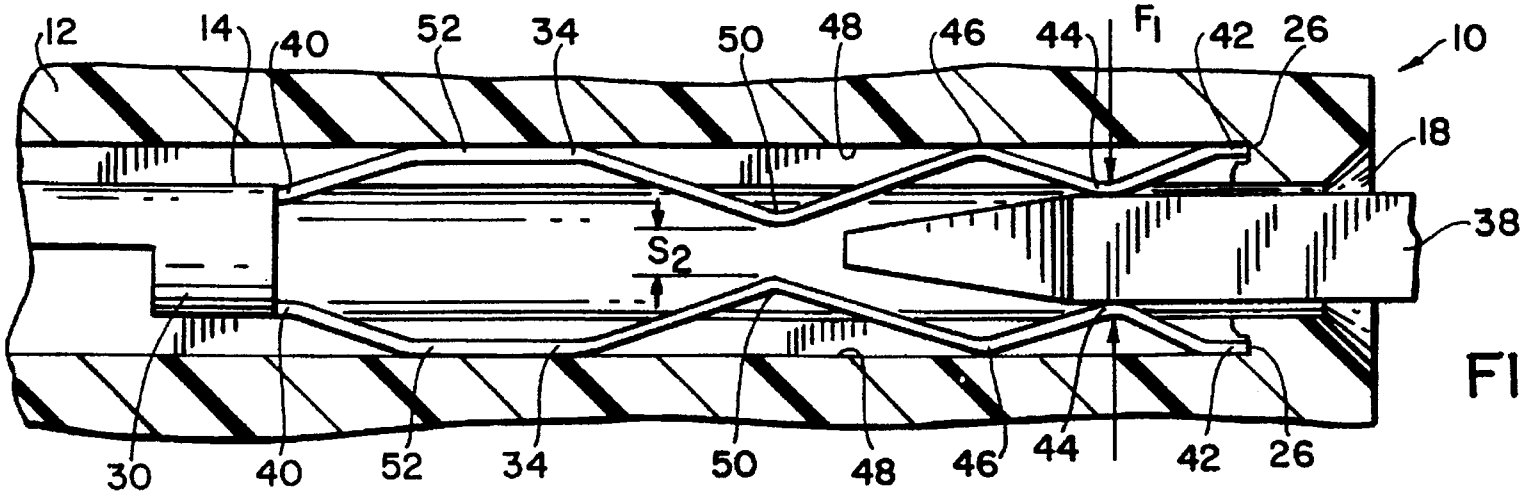
FIG. 2 is a partial sectional view of the connector as shown in FIG. 1 with a male contact partially inserted at a first depth of insertion.
Figure 3:
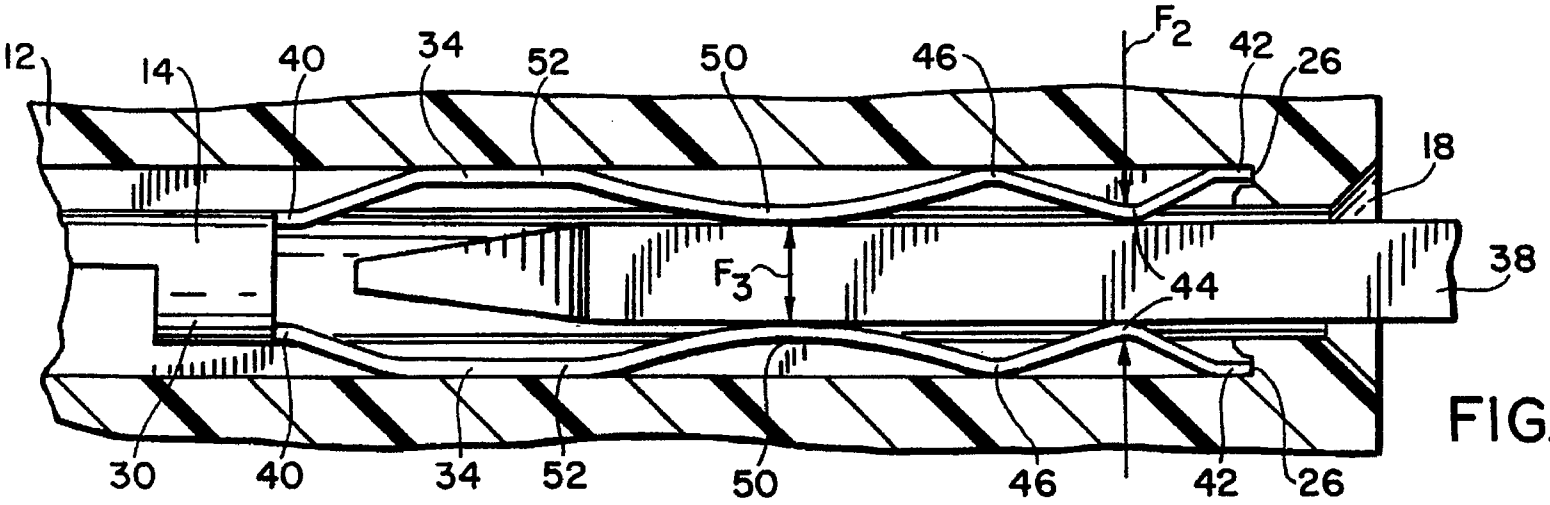
FIG. 3 is a partial sectional view of the connector shown in FIG. 2 with the male contact partially inserted at a second depth of insertion.

Referring now also to FIGS. 2 and 3, the behavior of the contact 14 will be described with regard to insertion of the male contact 38 into connection with the contact 14.

The male contact 38 is part of a second electrical connector. The male contact 38 is inserted into the connector 10 at the front aperture 18. As shown in FIG. 2, the male contact 38 is inserted, it contacts the contact areas of the first set of inwardly projecting ridges 44 at a first depth of insertion and presses the ridges slightly outward. The leaves 34 exert a force $F_1$ on the male contact 38 at this point. Because the leaves 34 are entrapped against outer wall 48 at their front ends 42 in pockets 26 and, are fixed to the housing 12 at their rear ends 40 by the middle section 30, the leaves must deform to compensate for the deflection of the first set of inwardly projecting ridges 44. This stationary feature of the two ends of the leaves, in combination with the contact of the two sets of outwardly projecting ridges 46, 52 with the outer walls 48 of the leaf channels, results in the initial spacing $S_1$ (see FIG. 1) between the second set of inwardly projecting ridges 50 decreasing to a spacing $S_2$.

As the male contact 38 is further inserted from the position shown in FIG. 2 to the position shown in FIG. 3, the male contact 38 contacts the second set of inwardly projecting ridges 50 and forces them apart. Because the ends 40, 42 of the leaves 34 are stationarily held in the housing 12 by the pockets 26 and fixed attachment of the middle section 30 to the housing, the leaves 34 have to deform again to compensate for the outward movement of the ridges 50 by the male contact 38. The stationary feature of the two ends 40, 42, in combination with the contact of the two sets of outwardly projecting ridges 46, 52 with the outer walls 48 of the leaf channels 24, results in the deformation of the leaves 34 as shown in FIG. 3. The force $F_3$ exerted against the second set of inwardly projecting ridges 50 causes the force exerted by the first set of inwardly projecting ridges 44 to be increased to the force $F_2$. Thus, contact of the male contact 38 with the second set of ridges 50 cams the leaves 34 into the male contact 38 at ridges 44 or causes a moment to be created in the leaves 34 to greatly increase the normal forces against the male contact 38. The two sets of outwardly projecting ridges 46, 52 function as hinges during the insertion process. Since the leaves of the contact are restrained on both ends, the leave assume the shape similar to a catenary when the male contact 38 is fully inserted. The elastic properties provided by this type of deformation will produce high normal forces even after many insertions and removals of the male contact 38. In addition, the contact 14 also provides the feature of two points of contact with the male contact 38 for each leaf 34. The connector 10 is thus a reliable, low contact resistance connector where the leaves reform themselves plastically and elastically to provide the reliability for repetitive insertions.

In alternate embodiments the contacts 14 could have more than two leaves each. Another alternate embodiment could have a contact with only one leaf; the male contact 38 being received and sandwiched between a portion of the housing 12 and the single leaf. The connector 10 could also include other types of contacts and/or other contact shapes. The contact leaves 34 could also have more inwardly projecting and outwardly projecting ridges.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector comprising:

a housing having contact receiving areas; and electrical contacts fixedly mounted to the housing and being located, at least partially, in the contact receiving areas, at least some of the contacts each including a female receiving area, the female receiving area having a first end stationarily fixed to the housing, a second end stationarily entrapped in a pocket of the housing, and a middle between the two ends adapted to be contacted by a male contact inserted into the female receiving area, wherein the middle has a general M-shaped contact leaf with two spaced contact areas for contacting the male contact.

2. A connector as in claim 1 wherein the female receiving area includes two opposing contact leaves.

3. A connector as in claim 1 wherein the middle has multiple contact leaves, each leaf having two spaced contact areas for contacting the male contact.

4. A connector as in claim 3 wherein each leaf has a first housing contact section between the two contact areas that is in contact with the housing.

5. A connector as in claim 4 wherein each leaf has a second housing contact section between one of the contact areas and the first end of the receiving area.

6. An electrical connector comprising:

a housing having a contact receiving area; and an electrical contact fixedly mounted to the housing inside the contact receiving area, the contact having a tail end extending out of the housing, a middle section fixedly mounted to the housing in the receiving area, a front end stationarily entrapped in a pocket of the housing, and a female contact section between the middle section and the front end for receiving a male contact, wherein the female contact section comprises multiple contact spring leaves and the front end comprises front ends of the spring leaves, and wherein the spring leaves each comprise two inwardly projecting ridges forming contact areas for contacting a male contact.

7. A connector as in claim 6 wherein each spring leaf has a housing contact section between the two ridges that is in contact with the housing.

8. A connector as in claim 6 wherein each spring leaf has a general "M" shape.

9. An electrical connector comprising:

a housing having a contact receiving area; and an electrical contact fixedly mounted to the housing in the receiving area, the contact having a first portion stationarily connected to the housing, a spaced second portion stationarily connected to the housing, and a female contact section between the first and second portions, the contact section having two inwardly projecting ridges and an outwardly projecting ridge, the outwardly projecting ridge being located between the two inwardly projecting ridges and, contacts the housing.

10. A connector as in claim 9 wherein the contact section includes multiple contact leaves each having a general "M" shape.

11. A connector as in claim 10 wherein the second portion comprises front ends of the contact leaves being stationarily entrapped in a pocket of the housing.

12. A connector as in claim 10 wherein the contact is made of a single member that is formed with a solder tail, a middle section that comprises the first portion, and the female contact section is located in front of the middle section.

13. A connector as in claim 12 wherein the middle section is fixedly mounted to the housing.

* * * * *